US010512824B2

(12) United States Patent
Gump

(10) Patent No.: US 10,512,824 B2
(45) Date of Patent: Dec. 24, 2019

(54) SPORTS TRAINING BALL WITH ENHANCED GRIPPING SURFACE

(71) Applicant: SWAX LAX LLC, Summit, NJ (US)

(72) Inventor: Laura Gump, Summit, NJ (US)

(73) Assignee: SWAX LAX LLC, Summit, NJ (US)

( * ) Notice: Subject to any disclaimer, the term of this patent is extended or adjusted under 35 U.S.C. 154(b) by 0 days.

(21) Appl. No.: 15/697,672

(22) Filed: Sep. 7, 2017

(65) Prior Publication Data

US 2018/0064999 A1 Mar. 8, 2018

Related U.S. Application Data

(60) Provisional application No. 62/477,023, filed on Mar. 27, 2017, provisional application No. 62/446,137, filed on Jan. 13, 2017.

(51) Int. Cl.
*A63B 37/12* (2006.01)
*A63B 43/00* (2006.01)
(Continued)

(52) U.S. Cl.
CPC ..... *A63B 37/12* (2013.01); *A63B 37/08* (2013.01); *A63B 43/00* (2013.01); *A63B 43/005* (2013.01);
(Continued)

(58) Field of Classification Search
CPC ... A63B 37/12; A63B 37/08; A63B 2037/082; A63B 37/14; A63B 2037/125; A63B 2102/14; A63B 69/0002
See application file for complete search history.

(56) References Cited

U.S. PATENT DOCUMENTS 2,081,531 A * 5/1937 Fegan ..... A63B 37/00
273/DIG. 15
2,093,737 A * 9/1937 Reach ..... A63B 37/00
156/213
(Continued)

FOREIGN PATENT DOCUMENTS

WO 02/089925 A1 11/2002
WO 2008/097711 A2 8/2008
(Continued)

OTHER PUBLICATIONS

"Hybrid Juggle Balls", Flying Clipper Juggling Supplies, Product Catalog, www.flyingclipper.com/tossaball-hybrid-juggling-balls, 3 pages (Last accessed Nov. 13, 2017).
(Continued)

*Primary Examiner* — Steven B Wong
(74) *Attorney, Agent, or Firm* — Hoffmann & Baron, LLP

(57) ABSTRACT

A sports ball, such as a lacrosse ball, comprising, an outer shell layer defining an enclosure having an interior volume for housing a filler material, the outer shell layer comprising a plurality of sections (pads or panels) connected along a plurality of seams, the sections having an outer surface comprising one or more layers of a substantially smooth non-woven synthetic leather, such as a synthetic suede, microfiber, or micro-velour, with an optional surface coating, which produce a frictional resistance (coefficient of friction) which decreases ball slippage against a surface or when released from the strings of a lacrosse stick.

23 Claims, 5 Drawing Sheets

(51) Int. Cl.

| | |
|---|---|
| ***A63B 37/08*** | (2006.01) |
| *A63B 102/18* | (2015.01) |
| *A63B 69/00* | (2006.01) |
| *A63B 71/00* | (2006.01) |
| *A63B 37/14* | (2006.01) |
| *A63B 102/14* | (2015.01) |
| *A63B 102/22* | (2015.01) |

(52) U.S. Cl.

CPC ..... *A63B 37/14* (2013.01); *A63B 69/0002* (2013.01); *A63B 69/0024* (2013.01); *A63B 71/0054* (2013.01); *A63B 2037/082* (2013.01); *A63B 2037/125* (2013.01); *A63B 2102/14* (2015.10); *A63B 2102/18* (2015.10); *A63B 2102/22* (2015.10); *A63B 2208/12* (2013.01); *A63B 2209/00* (2013.01); *A63B 2209/14* (2013.01); *A63B 2243/0033* (2013.01)

(56) References Cited

U.S. PATENT DOCUMENTS

| | | | | | |
|---|---|---|---|---|---|
| 2,138,004 | A | * | 11/1938 | Grau, Jr. | B29D 99/0042 156/170 |
| 2,494,806 | A | * | 1/1950 | Gibson | A63B 41/08 473/596 |
| 2,840,024 | A | | 6/1958 | Haas | |
| 3,069,170 | A | * | 12/1962 | Dillon, Jr. | A63B 37/0003 264/321 |
| 3,480,280 | A | | 11/1969 | Gamertsfelder | |
| D232,957 | S | * | 9/1974 | Kahelin | 473/597 |
| 4,151,994 | A | | 5/1979 | Stalberger, Jr. | |
| 4,354,679 | A | | 10/1982 | Steinmetz | |
| 4,448,418 | A | | 5/1984 | McNeill | |
| 4,643,424 | A | * | 2/1987 | Nakajima | A63B 37/00 264/239 |
| D292,014 | S | * | 9/1987 | Stalberger, Jr. | D21/713 |
| 4,872,676 | A | | 10/1989 | Townsend | |
| 4,880,233 | A | | 11/1989 | Song | |
| 4,943,066 | A | | 7/1990 | Lathim et al. | |
| 5,007,639 | A | | 4/1991 | Watson et al. | |
| 5,040,795 | A | * | 8/1991 | Sonntag | A63B 41/08 473/596 |
| 5,286,020 | A | * | 2/1994 | Caruso | A63B 41/00 473/603 |
| 5,310,178 | A | * | 5/1994 | Walker | A63B 41/08 273/DIG. 8 |
| 5,492,320 | A | | 2/1996 | Hoffman et al. | |
| 5,566,953 | A | | 10/1996 | Arriola | |
| 5,655,777 | A | | 8/1997 | Neading et al. | |
| 5,688,198 | A | * | 11/1997 | Teifert | A63B 37/12 473/598 |
| 5,711,729 | A | * | 1/1998 | Chan | A63B 37/0098 473/600 |
| 5,772,543 | A | | 6/1998 | Paino | |
| 5,788,591 | A | | 8/1998 | Decker | |
| 5,813,932 | A | | 9/1998 | Grafton | |
| 5,820,501 | A | | 10/1998 | Soofi | |
| 5,830,034 | A | | 11/1998 | Ciechanowski et al. | |
| 5,848,946 | A | | 12/1998 | Stillinger | |
| 5,893,811 | A | | 4/1999 | Stover et al. | |
| 5,910,059 | A | | 6/1999 | Hanson | |
| D422,040 | S | * | 3/2000 | Stalberger, Jr. | D21/713 |
| 6,053,829 | A | | 4/2000 | Conley | |
| 6,645,098 | B1 | | 11/2003 | Quinn | |
| 6,663,520 | B2 | | 12/2003 | Ou Chen | |
| 7,211,012 | B2 | | 5/2007 | Laliberty et al. | |
| 7,247,107 | B1 | * | 7/2007 | Bedwell | A63B 37/02 473/595 |
| 7,566,488 | B2 | * | 7/2009 | Mimura | A63B 39/06 428/137 |
| 7,785,219 | B2 | | 8/2010 | Avis | |
| 8,277,344 | B2 | | 10/2012 | Cea et al. | |
| 2004/0018901 | A1 | * | 1/2004 | Morrow | A63B 39/06 473/596 |
| 2004/0102265 | A1 | | 5/2004 | Laliberty et al. | |
| 2004/0142779 | A1 | * | 7/2004 | Chan | A63B 37/12 473/600 |
| 2004/0142780 | A1 | | 7/2004 | Estefano | |
| 2005/0143205 | A1 | * | 6/2005 | Yang | A63B 37/02 473/601 |
| 2005/0239584 | A1 | * | 10/2005 | Willyerd | A63B 69/0002 473/600 |
| 2008/0020874 | A1 | | 1/2008 | Huang et al. | |
| 2008/0051233 | A1 | * | 2/2008 | Nesbitt | A63B 37/0023 473/602 |
| 2008/0064535 | A1 | * | 3/2008 | Herman | A63B 37/00 473/446 |
| 2008/0194362 | A1 | | 8/2008 | Helmer et al. | |
| 2008/0242458 | A1 | | 10/2008 | Winn | |
| 2009/0209374 | A1 | * | 8/2009 | Ou | A63B 41/10 473/605 |
| 2011/0165978 | A1 | | 7/2011 | Leefeldt | |
| 2011/0226824 | A1 | | 9/2011 | Altavilla | |
| 2011/0312433 | A1 | | 12/2011 | Parenti | |
| 2012/0142464 | A1 | * | 6/2012 | Smith | A63B 43/02 473/597 |
| 2014/0342859 | A1 | | 11/2014 | Newman | |
| 2014/0357149 | A1 | | 12/2014 | Canobbio | |
| 2015/0045152 | A1 | * | 2/2015 | Hayes | A63B 39/00 473/446 |
| 2015/0328500 | A1 | * | 11/2015 | Hanson, Jr. | C08G 18/70 473/569 |
| 2016/0375317 | A1 | | 12/2016 | Connelly | |
| 2018/0008868 | A1 | * | 1/2018 | Gump | A63B 37/12 |

FOREIGN PATENT DOCUMENTS

| | | | |
|---|---|---|---|
| WO | 2013/006940 | A1 | 1/2013 |
| WO | 2016/118846 | A1 | 7/2016 |

OTHER PUBLICATIONS

"Sports Training Ball and Method of Manufacturing a Sports Training Ball", U.S. Appl. No. 15/544,155, filed Jul. 17, 2017.

International Search Report for International Application No. PCT/US2017/050402, dated Dec. 4, 2017.

Written Opinion for International Application No. PCT/US2017/050402, dated Dec. 4, 2017.

"The Engineering Toolbox: Densities of Common Materials," <https://www.engineeringtoolbox.com/density-materials-d_1652.html>, retrieved on Jul. 3, 2018.

Supplementary Partial EP Search Report for European Application No. EP 16740825, dated Jul. 16, 2018 (12 pages).

Campbell, Andrea, "The Great American Pastime: Baseball, Origins and Features", Bright Hub Education [online], Apr. 2014 [retrieved on Jul. 6, 2017]. Retrieved from the Internet: <URL:http//www.brighthubeducation.com/social-studies-help/128534-origins_and_features-of-baseball/> (3 pages).

International Search Report dated Jun. 3, 2016 issued in PCT/US2016/014500 (5 pages).

Written Opinion of the International Searching Authority dated Jun. 3, 2016 issued in PCT/US2016/014500 (9 pages).

* cited by examiner

SPORTS TRAINING BALL WITH ENHANCED GRIPPING SURFACE

CROSS-REFERENCE TO RELATED APPLICATIONS

This application claims the benefit of priority of U.S. Provisional Application No. 62/446,137, filed on Jan. 13, 2017, U.S. Provisional Application No. 62/477,023, filed on Mar. 27, 2017, and Pakistan Application No. 540/2016, filed on Sep. 7, 2016. The entire contents of the aforementioned applications are incorporated by reference herein.

BACKGROUND OF THE INVENTION

The present invention relates to sports balls having an outer shell (covering) which provides enhanced gripping and increased frictional engagement for handling, the outer shell providing housing for a filler material. The outer shell may be one or more layers of artificial leather constructed from a plurality of shaped sections (also referred to as panels or pads) designed to be joined together at seams to form a generally spherical ball. The covering may be made to accommodate a variety of ball sizes and the shaped sections may be all a single shape or may be mixed with other shapes to form the ball, depending on the size of the ball desired.

The present disclosure describes technology related to a ball for use in a sporting activity. The technology is well suited for use in "hard-ball" sports such as baseball, lacrosse, jai alai, field hockey, ice hockey, softball, hurling, and indoor roller hockey. Through the use of the techniques disclosed herein, a sporting goods manufacturer can generate sports balls that have advantages over those currently available. Such advantages include impact-absorbing qualities, softness, durability and improved safety for players, while maintaining the size and weight of a regulation ball. Sports balls with these qualities are able to withstand repeated impacts that occur during training while also being less likely to cause injury upon impact and accordingly are better suited for training.

Injuries and fear of injuries are obstacles to overcome in getting young people involved in sports. This is especially true for sports that involve playing with balls that have hard covers or hard outer surfaces or are entirely solid. It is not unusual in such sports for inexperienced players to either misdirect the ball so that it strikes someone else or to lose track of the flight of the ball and inadvertently be struck by it. Each of these circumstances can result is injuries to players or bystanders of a sport.

The risk of such injuries can cause novices (especially children) to forego a sport altogether or, in the event that they do try to learn the sport, to have a more difficult time learning the sport due to a fear of being hit. Anxieties among novice players can be detrimental to the growth of popularity of a sport. Lacrosse is an example of a sport that is gaining in popularity, but its popularity may be limited because it is played with a hard rubber ball. A lacrosse ball is an example of the type of ball that can cause anxiety in novice players. Some players are less likely to take up a sport such as lacrosse due to the protective equipment required for the game. Lacrosse balls that absorb impact when they make contact reduce the importance of such protective equipment and thus may encourage greater participation in the sport.

In lacrosse, for example, a need exists for a sports training ball that flies and throws in a similar fashion as a regulation ball but absorbs impact in the event of a collision. Such sports training balls would allow players of the game to train in a safe and confident manner. To be best suited for training, a ball needs to meet the specification of the game's governing body with regard to aerodynamic and physical properties (e.g., weight, air-resistance, and circumference) so that the training ball is similar to a ball that would be used in an official competition. However, for training purposes such an improved ball should absorb impact so as to minimize harm to players if or when they are struck and thereby minimize the anxieties of new players. Reducing anxiety also increases players' ability to learn proper stick skills and form (e.g., in lacrosse, the stick should be held close to the body) because they are not as afraid of getting hit by the ball. Furthermore, a sports ball for use in training must be designed and built to maintain impact-absorption and aerodynamic properties through numerous impacts and through demanding usage.

SUMMARY OF THE INVENTION

In one aspect of the invention, there is provided a lacrosse ball component which includes, an outer shell layer defining an enclosure having an interior volume for housing a filler material, the outer shell layer comprising a plurality of sections (pads, panels or pouches) connected along a plurality of seams, the sections having an outer surface made from a substantially smooth, non-woven synthetic leather which imparts a frictional resistance (coefficient of friction) and decreases ball slippage when released from the strings of a lacrosse stick. The outer shell may include multiple layers joined together by, for example, adhesive lamination, heat melting, or mechanically joining such as by sewing or suturing. The outer shell may comprise an inner layer and an outer layer. The inner layer may comprise a synthetic leather, such as suede, while the outer layer may comprise a synthetic leather and, optionally, a surface coating thereon. The surface coating may be a polymer, such as polyurethane, or a silicone. The substantially smooth, non-woven synthetic leather may optionally be patterned and/or textured. In an aspect when the outer layer comprises a synthetic leather with a polyurethane coating, it may have a thickness in the range of about 1.2 mm to about 1.8 mm, or about 1.4 mm to about 1.5 mm, and an inner layer of synthetic suede may have a thickness in the range of about 0.2 to about 0.8 mm, or about 0.4 to about 0.5 mm. The lacrosse ball may include a filler, optionally comprising two materials, which may include sand and/or rubber particles.

In another aspect of the invention, there is provided a lacrosse ball component comprising an outer shell layer defining an enclosure having an interior volume for housing a filler material, the outer shell layer comprising a plurality of sections (pads, panels or pouches) connected along a plurality of seams, the sections having an outer surface which includes a substantially smooth natural leather or a substantially smooth, synthetic non-woven leather having a surface coating, the surface coating imparting a frictional resistance for handling and particularly when the ball is released from the lacrosse strings. The surface coating decreases ball slippage when released from the strings of a lacrosse stick, thereby providing for better control and accuracy of the shot. The shell may include multiple layers joined together by, for example, adhesive lamination, heat-melting, or mechanically joining such as by sewing or suturing, the outer most shell layer having the coating applied thereon.

In a further aspect of the invention, there is provided a sports ball comprising an outer shell layer defining an enclosure having an interior volume for housing a filler material, the outer shell layer comprising a plurality of sections (pads, panels or pouches) connected along a plurality of seams, the sections having an outer surface comprising a substantially smooth non-woven synthetic leather, optionally provided with a surface coating thereon, which produce a frictional resistance which provides enhanced gripping against a surface. The outer shell further may comprise an inner layer of a substantially smooth non-woven synthetic suede (or velour) and an outer layer of a substantially smooth, non-woven synthetic leather, optionally provided with a surface coating thereon.

In yet a further aspect of the invention, there is provided a sports ball that is made up of an outer shell having enhanced gripping and increased frictional engagement as described herein, the shell further including a plurality of sections, the sections being of a variety of polygonal shapes. The ball may have all the outer shell sections of a single type of polygon, such as all pentagonal shaped sections, or a combination of different polygons, such as for example hexagonal and pentagonal. One particularly desirable outer shell is made from 12 pentagonal shaped sections. Each section has a respective section interior volume and the shell defines a second interior volume. Each section interior volume is substantially occupied by a first filler (e.g., sand) having a first density. The second interior volume is substantially occupied by a second filler (e.g., rubber (elastomeric) pellets or finely comminuted elastomer) having a second density which is less than the first density. Alternatively, two or more filler materials as described herein, e.g., sand and rubber, may be substantially uniformly mixed together to form a composite filler material.

DETAILED DESCRIPTION OF THE INVENTION

Figure 1:
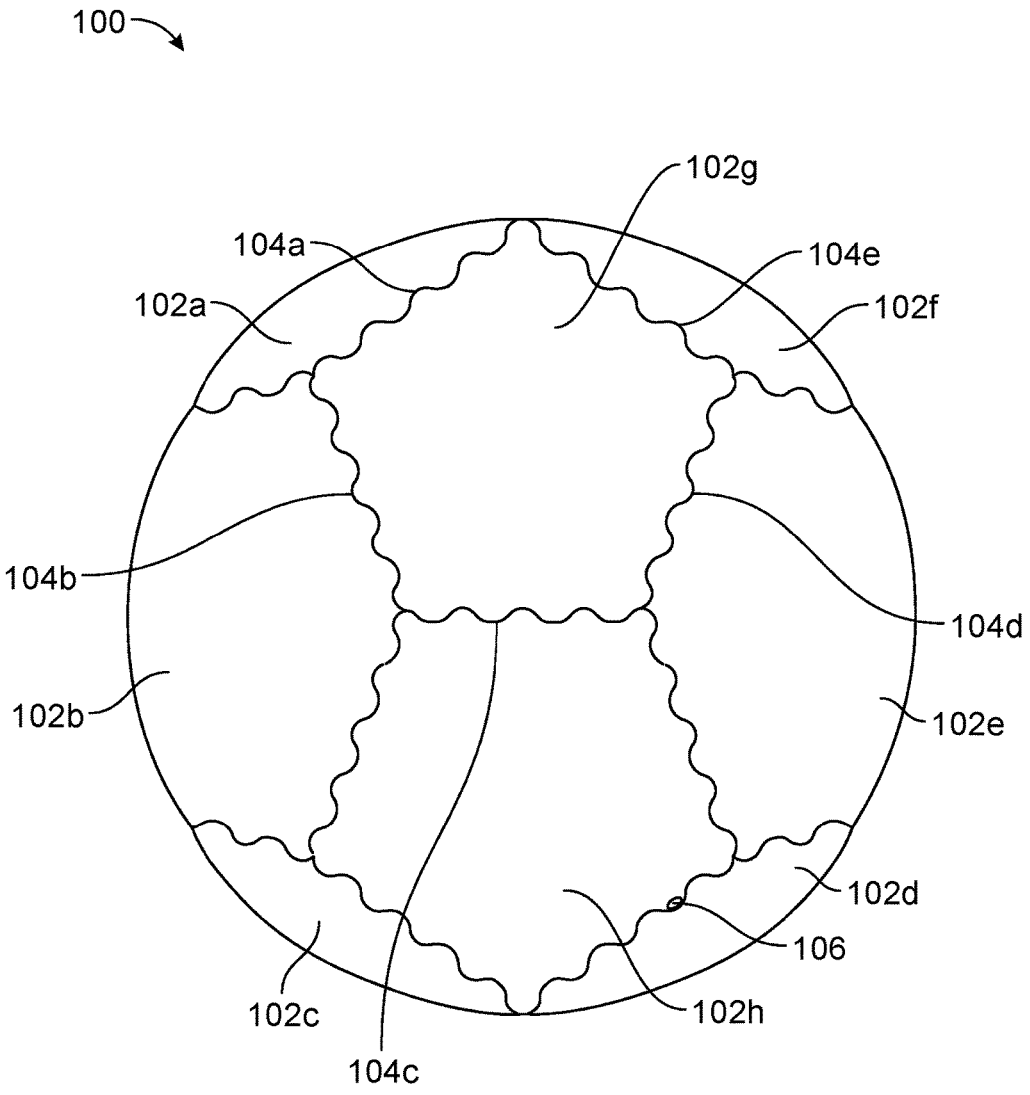
FIG. 1 is a perspective view of an exterior of a sports ball in accordance with an embodiment of the subject application.

The present invention incorporates by reference PCT/US2016/014500 in its entirety. The method of assembling the ball, as well as various components of a ball useful with the present invention is disclosed therein.

Provided herein is a sports ball, optionally a lacrosse ball, which includes, an outer shell layer defining an enclosure having an interior volume for housing a filler material, the outer shell layer comprising a plurality of sections (pads, panels or pouches) connected along a plurality of seams, the sections having an outer surface made from a substantially smooth, non-woven synthetic leather which imparts a frictional resistance (coefficient of friction) and decreases ball slippage when released from the strings of a lacrosse stick. The outer shell thus provides enhanced grip to the lacrosse strings as the ball is cradled by the player and particularly when the ball is thrown or shot and released from the strings. The enhanced gripping is intended to approximate the "feel" of a conventional regulation lacrosse ball made entirely from hard, solid elastomeric material. The shells (and balls made therefrom) of the present provide significantly better control of the shot and hence better accuracy (particularly at high throwing speeds) as compared to prior training balls which do not include the gripping surface. The shell may include multiple layers joined together by, for example, adhesive lamination, heat melting, or mechanically joining such as by sewing or suturing. The inner layer may comprise a synthetic leather, such as suede, while the outer layer may comprise a synthetic leather and a surface coating thereon. The shells may be further assembled with a filler and stitching to produce a finished lacrosse training ball which provides players with the "feel" of a regulation lacrosse ball, but with the advantages of a being significantly softer when the ball hits a player's body, having very little bounce and doing less damage to surfaces when thrown at high speeds. Whereas prior shell materials made from synthetic leather known as WRP 7400 Rexane with a leather grain surface, as disclosed in PCT/US2016/014500, did not have the gripping characteristics required for providing a friction surface similar to a new and unused rubber lacrosse ball, the shell of the present invention as further described herein is made from an inventive synthetic leather combination having improved tackiness meeting the requisite frictional surface and characteristics for providing the feel of a new and unused rubber lacrosse ball. Because of the increased tackiness of the outer shell, an inventive lacrosse ball, for example, sticks a little longer to the strings of the stick thereby improving shooting accuracy, especially at high speeds.

An important aspect of the sports training balls as disclosed herein is their durability. That durability is necessary to withstand the rigors of training in sports such as lacrosse. Unlike other sewn balls, lacrosse training balls require a strong thread and a particular method of tying off the thread so that, in the event that the fabric of the ball surface fails, the thread will not fail. This design feature, as described in co-owned PCT/US2016/014500, is particularly important in developing a sports training ball that can withstand multiple consecutive throws and collisions (against a goal post and/or a wall) of greater than 70 mph (professional lacrosse players can crank a ball at speeds in excess of 100 M.P.H.) as is required in sports such as lacrosse and baseball.

In addition to the durability of sports training balls as disclosed herein, a further advantageous quality relates to the lack of recoil upon impact in comparison to regulation lacrosse balls. Regulation lacrosse balls have a tendency to bounce and roll when they hit the ground or cross bar of a goal. Sports training balls as described herein tend not to roll away and to stay closer to the training area in comparison resulting in less time spent chasing balls during practice. This is due to the design of the outer shell being quilted as opposed to smooth rubber as in the regulation lacrosse ball.

Training balls made from the outer shell layers of the invention are particularly useful for indoor training where grass or artificial turf is not available, for example, surfaces such as hardwood gym floors and have the advantage of not marking the floors as regulation balls are prone to do. Other advantages include not denting the floors, walls and bleachers, and avoiding the chaos associated with balls bouncing all over the space if a pass is missed by a player, or ricochets off a wall or goal post. Overall, indoor training and play, as well as outdoor, is greatly improved.

Definitions

The terms "sports ball" or "sports training ball" as used herein refers to a ball used in a sport or for a similar entertainment purpose. In certain embodiments, sports balls as disclosed herein may be used for a sport such as lacrosse, including regulation size balls, heavy balls and mini balls, as well as any other desired size. In other embodiments, sports balls as disclosed herein may be used for other sports such as baseball, softball, field hockey, handball, team handball, rounder's, cricket, polo, jai alai, hurling, ice hockey, indoor roller hockey, street hockey, or similar sports. In certain other sports, collisions between players and equipment (such as pucks, balls, and the like) may also cause injury. It should be understood that the techniques as described herein may be applied to other geometries than balls, for example pucks and the like.

As used herein, the words "section(s) of a shell", "pad" or "pads" are used interchangeably with the words "panel" or "panels" or "pouch" or "pouches".

The terms "softer" or "harder" as used herein refer to the relative hardness of different materials. The hardness of materials (e.g., polymers, rubbers, and elastomer) is measured in various ways, for example by the Rockwell hardness test or the Shore (Durometer) hardness test. Such methods measure the resistance of the material toward indentation and provide an empirical value that corresponds to the quality of hardness or softness of a tested material. In addition, as used herein, density refers to the mass of a material divided by its volume.

"Compression" as used herein refers to the results of ASTM F 1888 Compression-Displacement Tests conducted on the balls of the present disclosure.

"Coefficient of Restitution (COR)" refers to the results of ASTM F 1887 Measuring the Coefficient of Restitution (COR) Tests conducted on balls of the present disclosure.

"Coefficient of Friction" is per the NOCSAE football receiver glove standard ND019.

"Regulation" lacrosse ball means a solid, smooth, non-seamed rubber (elastomeric) ball which meets the guidelines of the National Operating Committee on Standards for Athletic Equipment (NOCSAE) or the governing body for lacrosse. For example, NOCSAE Document 049-14m15, which is incorporated herein by reference, governs the standards for performance for newly manufactured lacrosse balls. The average circumference of regulation balls must be within 7.75 inches (19.68 cm) to 8.0 inches (20.32 cm), calculated by taking the average of two measurements taken 90°+/−5° apart. The average weight of regulation lacrosse balls is 5.0 ounces (142 g) to 5.25 ounces (149 g). The compression values of regulation lacrosse balls using ASTM F 1888 test method must be within 160 lbs.+/−50 lbs., after a displacement of 25+/−0.05%, at a constant rate of 1 in. per minute+/−3%. The average diameter of a regulation ball is 64, +/−1 mm.

"Regulation" sports ball means a ball of a chosen sport which meets the guidelines of the NOCSAE, or the governing body for that sport.

"Synthetic leather" or "artificial leather" refers to a man-made, polymeric material that generally resembles leather in appearance, but which has a surface designed to provide gripping due to its enhanced frictional characteristic (coefficient of friction) and relative "tackiness" as compared to artificial leather that does not provide similar characteristics. The term artificial leather includes, without limitation, artificial suede, artificial microfiber and artificial velour types. Such polymeric material used to make the artificial leather includes polyurethanes, polyesters, poly acrylics, polyolefins, nylons and combinations thereof, such as mixtures, homo-polymers and copolymers of these materials. In particular, this term as used for ball made in accordance with in the present invention refers to the following materials: KR GRIPPE PU material (available from Korea); Amara synthetic suede; WBB7400P by Japanese Teijin Cordley.

Training Ball Components

Outer Shell Layer(s)

The training balls of the present invention include an outer shell layer. This layer (component) of the sports ball is made from a gripping material, i.e., a material that has a surface "tackiness" (frictional resistance (coefficient of friction)) which allows for enhanced gripping of the ball by the equipment used (e.g., lacrosse strings, field hockey stick, jai alai basket, indoor hockey ball) or by the hand (e.g., baseball, softball, baseball glove, softball glove, sliotar). For example, when the inventive ball is designed for lacrosse, enhanced gripping of the outer shell allows for better throwing and shooting accuracy, particularly at high speeds, and is designed to simulate the gripping by the lacrosse stick strings of a regulation lacrosse ball.

In an embodiment, the weight and size (circumference) of the inventive ball may substantially match those of a regulation lacrosse ball. In another embodiment, the inventive ball may be designed to meet the regulation weight and size of a ball used in a sport other than lacrosse, such as but not limited to, baseball, softball, and field hockey. In yet another embodiment, the inventive ball may be designed to have a weight and size of any desired amount, or substantially matching any commonly known or used ball. The shell weight, either has single layers or multiple layers, may be in the range of about 10 g to about 30 g, or about 15 g to about 25 g. For an inventive regulation lacrosse ball, the shell weight is in the range of about 11 g to about 28 g, about 15 g to about 25 g, or about 20 g. For a heavy lacrosse ball, the shell weight may be in the range of about 11 g to about 28 g, about 12 g to about 25 g, or about 13 g. For a mini lacrosse ball, the shell weight may be in the range of about 9 g to about 13 g, preferably about 11 g. When used for lacrosse, the shells used for making the balls of the present invention provide the player with the "feel" of a regulation lacrosse ball, but with substantially less hardness, and more compression.

The shell sections (pads or panels) may be cut into an appropriate shape (for example, a pentagonal, triangular, or rectangular shape) by any suitable means, e.g., a hydraulic press (for example, a clicker press) that is instrumented with an appropriate cutting dye that is used to cut the material. Sewing holes may also be punched in the material in preparation for sewing the sections together to form the ball. In certain embodiments, such as the embodiment illustrated in FIGS. 1 and 2, the sections are shaped as regular pentagons (that is, all sides are equal), with each side having a length of e.g., about 1.2 inches. Such embodiments provide the advantageous geometrical properties of a regular dodecahedron. The outer shell layer may comprise any number of pads or panels, including but not limited 2-64, 2-14, 2, 4, 6, 8, 10, 12, 14, 16, 18, or 20 pads or panels. In an embodiment, the outer shell layer may comprise 2, 4, 6, 8, or 12 pads or panels.

In certain embodiments of the present disclosure, a sports training ball appropriate for lacrosse training embodies the technology described in the present disclosure. In such embodiments, the surface of the ball is made up of twelve shell sections and each of the sections is shaped as a regular pentagon. In order to provide the aerodynamic qualities of a regulation lacrosse ball, such a sports training ball has an average circumference between about 7.5 inches (about 19.05 cm) to about 8.5 inches (about 21.59 cm), or preferably about 7.75 inches (about 19.68 cm) to about 8.0 inches (about 20.32 cm), and an average weight between about 130 grams ("g") (4.6 ounces) to about 155 g (5.5 ounces), or preferably about 5.0 ounces to about 5.25 ounces. For such embodiments, the shell of the sports training ball has a substantially spherical shape that has a circumference in the range of about 19.0 cm (7.5 inches) to about 21.6 cm (8.5 inches), or to about 21.0 centimeters (8.3 inches). In an embodiment, the diameter of the ball is about 64 mm+/−4 mm, or about 64 mm+/−1 mm.

In another embodiment, the inventive ball may be substantially the same size as the regulation lacrosse ball but heavier, referred to herein as a "heavy ball" or "heavy lacrosse ball." The heavy ball may have an average circumference between about 7.5 inches (about 19.05 cm) to about 8.5 inches (about 21.59 cm), or preferably about 7.75 inches (about 19.68 cm) to about 8.0 inches (about 20.32 cm), and an average weight about 12% to about 18% heavier, or preferably about 15% heavier, than the regulation lacrosse ball. In an embodiment, the heavy ball weighs about 160 g to about 170 g, or about 163 g to about 168 g, or about 165 g. Much like when a baseball player warms up with a weighted bat during batting practice, a lacrosse player may use a heavy ball to practice shooting and throwing. The heavy ball is generally more difficult to control than a regulation lacrosse ball, so when the player switches back to using a regulation lacrosse ball (at a regulation weight that is less than the heavy ball), shooting speed and accuracy may increase because the ball then feels significantly lighter in the stick.

In yet another embodiment, the weight and size (circumference) of the inventive ball may substantially match those of a mini lacrosse ball (or "mini ball") known for use with lacrosse mini-sticks or fiddle sticks. Fiddle sticks are popular with young children and for indoor and outdoor play. When made for use with mini lacrosse sticks, the sports training ball of the present disclosure has an average circumference between about 6.5 inches to about 7.5 inches, or about 7.0 inches, and an average weight between about 100 g to about 130 g. In an embodiment, the mini lacrosse ball weighs about 126 g; in another, it weighs about 107 g. The mini lacrosse ball is generally about ⅞ the size of the regulation lacrosse ball. The surface of the ball may be made up of shell with twelve sections and each of the sections may be shaped as a pentagon.

The outer shell of a sports training ball in accordance with the disclosure may comprise a pattern on its surface. Such patterns may be in the form of a geometric shape. One such pattern may be a series of holes on the surface, as shown, e.g., in FIG. 5.

When each of the twelve pentagonal sections is sewn in position on such a regulation lacrosse training ball, the portion of each regular pentagon that is visible on the surface of the ball has sides that are each 1 inch in length. The remaining 0.2 inches of length for each side of the pentagons are inside the ball as can be seen in FIGS. 5B-5C of PCT/US2016/014500, previously incorporated herein by reference.

The shells may include one or more layers of material. For example, an outer enhanced frictional layer may be laminated or otherwise joined with an additional layer of artificial material such as synthetic leather, e.g. synthetic suede, or in some instances laminated with a woven textile material, such a cotton or polyester fabric.

One particularly useful outer shell made from a multilayer cover includes one or more layers of a synthetic non-woven leather laminated to one of more layers of a synthetic suede (for example, Amara material). The synthetic non-woven leather may be the outer layer or the inner layer, with the synthetic suede being the other. When the synthetic non-woven leather is the outer layer, it may comprise a surface coating thereon, optionally a polymer, such as polyurethane, or a silicone. The outer layer may be GRIPPE PU, which is a synthetic leather backing covered with a layer of polyurethane (PU) that is applied to the surface and then embossed. When there are two layers, the outer layer may comprise a synthetic leather with a polyurethane coating, such as GRIPPE PU, and have a thickness in the range of about 1.2 mm to about 1.8 mm, or about 1.4 mm to about 1.5 mm, and the inner layer may comprise a synthetic suede and have a thickness in the range of about 0.2 to about 0.8 mm, or about 0.4 to about 0.5 mm.

Filler Material

Whereas regulation lacrosse balls are relatively hard and are formed from solid elastomeric material without a seam, the balls of the present invention are considerably softer and more compressible. The filler of the inventive balls includes a mixture of a first material and a second material. The filler substantially occupies the interior volume of the ball's shell. The first material desirably has a different density than the second material. Examples of material useful include sand, comminuted polymer particles, comminuted rubber particles, comminuted stone and fine powder from stone or polymer. Additionally, in some embodiments other particulates such as birdseed and millet may be included as further additives to the aforementioned fillers, Particularly useful fillers include sand, comminuted plastic particles, comminuted rubber (elastomer) particles, comminuted stone particles and combinations thereof. The rubber may be recycled.

Useful sand fillers include medium to fine grade sand which according to the Wentworth Scale have an average diameter of about 0.125 mm to about 1.0 mm, or about 0.125 mm to about 0.5 mm. The particle size is based on the Wentworth scale for particle measurement.

TABLE 1

Wentworth Scale for Measurement of Particles and Grain

| φ scale | Size range (metric) | Size range (inches) | Aggregate name (Wentworth class) | Other names |
|---|---|---|---|---|
| <−8 | >256 mm | >10.1 in | Boulder | |
| −6 to −8 | 64-256 mm | 2.5-10.1 in | Cobble | |
| −5 to −6 | 32-64 mm | 1.26-2.5 in | Very coarse gravel | Pebble |
| −4 to −5 | 16-32 mm | 0.63-1.26 in | Coarse gravel | Pebble |
| −3 to −4 | 8-16 mm | 0.31-0.63 in | Medium gravel | Pebble |
| −2 to −3 | 4-8 mm | 0.157-0.31 in | Fine gravel | Pebble |
| −1 to −2 | 2-4 mm | 0.079-0.157 in | Very fine gravel | Granule |

TABLE 1-continued

Wentworth Scale for Measurement of Particles and Grain

| φ scale | Size range (metric) | Size range (inches) | Aggregate name (Wentworth class) | Other names |
|---|---|---|---|---|
| 0 to −1 | 1-2 mm | 0.039-0.079 in | Very coarse sand | |
| 1 to 0 | 0.5-1 mm | 0.020-0.039 in | Coarse sand | |
| 2 to 1 | 0.25-0.5 mm | 0.010-0.020 in | Medium sand | |
| 3 to 2 | 125-250 μm | 0.0049-0.010 in | Fine sand | |
| 4 to 3 | 62.5-125 μm | 0.0025-0.0049 in | Very fine sand | |
| 8 to 4 | 3.9-62.5 μm | 0.00015-0.0025 in | Silt | Mud |
| 10 to 8 | 0.98-3.9 μm | $3.8 \times 10^{-5}$-0.00015 in | Clay | Mud |
| 20 to 10 | 0.95-977 nm | $3.8 \times 10^{-8}$-$3.8 \times 10^{-5}$ in | Colloid | Mud |

Average particle sizes (diameters) of comminuted rubber particles or other elastomeric fillers are generally in the range of about 0.0625 mm ("very fine sand") to about 2.00 mm ("granule").

Average particle sizes (diameters) of comminuted stone particles or other solid fillers are generally in the range of about 0.0625 mm ("very fine sand") to about 2.00 mm ("granule"), or about 0.0625 mm ("very fine sand") to about 1.00 mm ("coarse sand").

The relative amounts of the two filler materials is also important because, in certain embodiments, the ball is intended to meet the size and weight of a regulation ball, but be softer, more compressible and maintain impact absorption so that it hurts less on the body than a regulation ball. Desirably, the two filler materials are substantially uniformly mixed together and loaded into the interior volume of the outer shell. Ratios of the first filler material to the second filler material may be about 50:80 to about 90:40. This includes ranges of ratios of about 50-90:40-80, 50-90:50-70, 50-90:55-60, 60-90:40-80, 60-90:50-70, 60-90:55-60, 70-90:40-80, 70-90:50-70, 70-90:55-60, 75-80:40-80, 75-80:50-70, and 75-80:55-60. This further includes any specific ratio values, such as 50:40, 50:50, 50:55, 50:60, 50:70, 50:80, 60:40, 60:50, 60:55, 60:60, 60:70, 60:80, 70:40, 70:50, 70:55, 70:60, 70:70, 70:80, 75:40, 75:50, 75:55, 75:60, 75:70, 75:80, 80:40, 80:50, 80:55, 80:60, 80:70, 80:80, 90:40, 90:50, 90:55, 90:60, 90:70, and 90:80. Moreover, each of these specific ratio values may serve as endpoints of a range of ratios in conjunction with any other one of these specific ratio values.

When sand is used as a filler, the amount of sand may generally range from about 50 g to about 120 g of sand, or about 60 g to about 107 g. For a regulation lacrosse training ball, the amount of sand may range from about 50 g to about 120 g of sand, about 60 g to about 100 g, or from about 70 g to about 90 g.

When rubber is used as a filler, the amount of comminuted rubber (elastomer) may be in the range of about 30 g to about 80 g, or about 35 g to about 80 g. For a regulation lacrosse training ball, the amount of comminuted rubber (elastomer) may be in the range of about 30 g to about 80 g, about 50 g to about 70 g, or about 50 g to about 60 g. In some embodiments, sand may be combined with comminuted rubber (elastomer) and/or comminuted stone, for example, about 55 g of rubber and about 75 g to about 80 g of comminuted stone; or about 66 g of a combination of rubber and comminuted stone.

For certain embodiments, such filler mixtures for an inventive lacrosse ball being about the size and weight of a regulation lacrosse training ball include about 90 grams of refined sand and about 55 grams of comminuted rubber (elastomer) particles, or about 70 grams of refined sand and about 50 grams of comminuted rubber (elastomer) particles. For certain embodiments, the mixture of sand to rubber may be varied to create filler that has a total mass in the range of about 120 grams to about 150 grams. For other embodiments, the mixture of grains of sand to comminuted elastomer may be varied to create filler that has a total mass in the range of about 144 grams to about 147 grams. For yet other embodiments, the mixture of sand to rubber may be varied to create a filler that has a total mass in the range of about 145 grams to about 146 grams. In a certain embodiment, the ratio of the mass of the rubber in the filler to the mass of the sand in the filler is in the range of about 0.55 to about 0.65. In an embodiment thereof, the ratio of the mass of the rubber in the filler to the mass of the sand in the filler is in the range of about 0.55 to about 0.75, about 0.60 to about 0.72, or about 0.55 to about 0.65 and achieves the exact dimensions of the regulation lacrosse ball. Much work, experiments and tests was put in to select the right combination of filler and determine the correct ratio to meet the exact dimensions of the regulation lacrosse ball.

A filler mixture may be introduced to the interior volume of a shell of the ball by combining the two materials and pouring the combination into the interior volume with a funnel until the appropriate mass of material has been filled into the interior volume.

For an inventive heavy ball, the filler mixture may include about 100 g to about 115 g, or about 107 g, of refined sand and about 40 g to about 50 g, or about 45 g, of comminuted rubber (elastomer) particles. For an inventive mini ball, the filler mixture may include about 55 g to about 65 g, or about 60 g, of refined sand and about 30 g to about 40 g, or about 36 g of comminuted rubber (elastomer) particles.

In an embodiment, a heavy ball weighs a total of about 165 g: 13 g empty shell, 45 g rubber, and 107 g sand. In an embodiment, a mini ball has an average circumference of about 7.0 inches and weighs a total of about 107 g: 11 g empty shell, 36 g rubber, and 60 g sand.

In an embodiment, a lacrosse training ball made in accordance with this disclosure compresses to about 25% of its diameter between two platens under about 55 lbs to about 100 lbs (compression load), about 60 lbs to about 95 lbs, or about 70 lbs to about 95 lbs. In contrast, a conventional regulation lacrosse ball requires a compression load of 160±50 to compress to the same amount under the same conditions. Because the inventive ball is more easily compressed (with less load), the point of impact when a ball hits a target (such as a player) is diffused, suggesting potentially safer play with less potential for injury.

Stitching

The balls made in accordance with the present invention may be stitched together using a multiply thread. A thread of any ply known in the art may be used. For example, a 1-ply, 2-ply, 3-ply, 4-ply, 5-ply, 8-ply, 10-ply, 12-ply, 16-ply thread may be used. In an embodiment, a 12-ply, No. 12 Beeswax thread is used. Threads may be from natural fibers or synthetic fibers, such as polyester fibers or nylon.

The balls made in accordance with the present invention may be single stitched, double stitched, triple stitched, quadruple stitched or greater, depending on the type of sports ball being made. For example, lacrosse training balls made may have single stitching, double stitching or triple stitching or higher. When the ball is designed for higher throwing and speeds, the level of stitching may concomitantly be higher as well to prevent the ball from breaking and releasing the filling. The stitching is generally designed not to break before the outer shell breaks in both testing and use.

In an embodiment, lacrosse training balls made in accordance with this disclosure do not break when thrown 10 or more consecutive times against metal plates at speeds up to 70 MPH, about 50-about 70 mph, or about 55-about 70 MPH. Lacrosse training balls made in accordance with this disclosure do not break when thrown 20, 30 or 40 times against metal plates at speeds up to 70 MPH, about 50-about 70 mph, or about 55-about 70 MPH. In another embodiment, lacrosse training balls made in accordance with this disclosure do not break when thrown 10 or more consecutive times against walls of brick or concrete at speeds up to 70 MPH, about 50-about 70 mph, or about 55-about 70 MPH. Lacrosse training balls made in accordance with this disclosure do not break when thrown 20, 30 or 40 times against walls of brick or concrete at speeds up to 70 MPH, about 50-about 70 mph, or about 55-about 70 MPH. The ball does "not break" means that the seams do not break or rip and no beads are released. It also may be phrased as remaining intact. This is in contrast to stitched balls in the prior art made from synthetic rubbers and containing plastic pellets or beads and which break when tested at such speeds, leaking filler material. Moreover, the balls of the prior art fail to include shell materials which provide the enhanced surface friction to simulate the tacky texture of new regulation rubber lacrosse balls, as do the inventive training balls of the present disclosure.

Adhesives

When multiple layers are used to construct the outer shell, they may be joined by laminating the layers using various methods, including adhesive, hot melting the layers together, or by mechanical devices such as stitching. Desirably the layers are joined by adhesive lamination. The joined layers should substantially retain the flexibility of each layers, and not separate on impact, such as when caught at high speeds, or when tested for COR (Coefficient of Restitution).

Useful adhesives include those that have a degree of flexibility when cured, such as natural latex adhesives or synthetic rubber adhesives. One useful brand of adhesive is sold under the Kangaroo brand name, for example Kangaroo 505. Synthetic adhesives, such as SBR rubbers may also be used.

Hot melt adhesives may also be used to laminate the layers, for example, those adhesives made from ethylene-vinyl acetate (EVA), optionally with additives therein, such as wax and/or resin.

In addition to lamination of shell layers, adhesives may also be applied to the knots used to tie-off the stitches, to prevent potential loosing.

An embodiment is a sports training ball, for example a lacrosse ball, comprising an outer shell layer comprising a plurality of sections connected along a plurality of seams, the sections having an outer surface comprising an outer layer of a smooth non-woven synthetic leather (which optionally may be patterned and/or textured) with a polymer or silicone coating thereon, the outer layer is laminated on the side without the coating to an under layer of a non-woven synthetic suede or velour. Lamination may be achieved using an adhesive such as a hot melt adhesive, for example, EVA (ethylene vinyl-acetate) glue. The lacrosse training ball may optionally be of regulation size and weight. It also may be manufactured to be regulation size but of a greater weight than approved for regulation lacrosse balls. The outer surface may weigh about 15 g to about 25 g, or about 20 g. The filler may comprise a mixture of refined sand, optionally about 60 g to about 100 g, about 70 g to about 90 g, or about 70 g, and comminuted rubber, optionally 30 g to about 80 g, about 50 g to about 70 g, or about 50 g.

Figure 2:
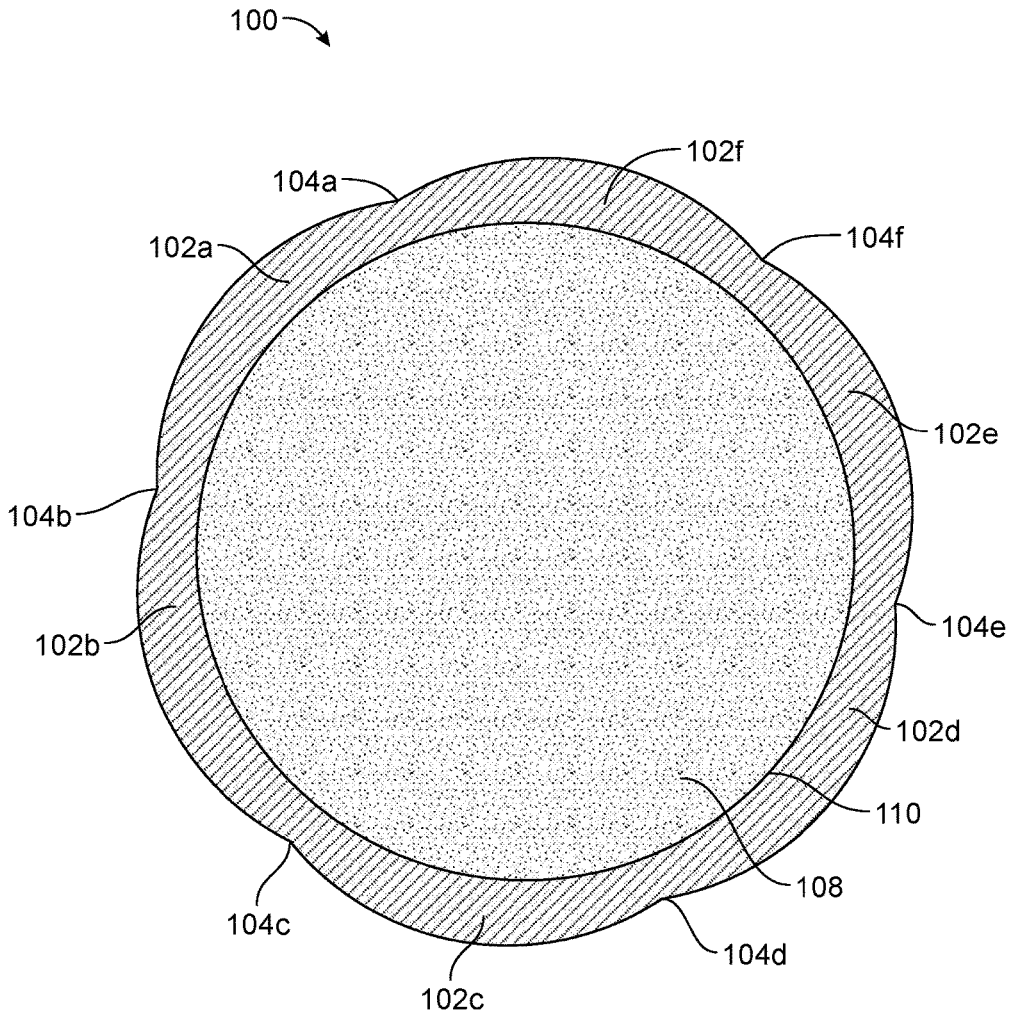
FIG. 2 is a side cross-sectional view of the sports ball as shown in FIG. 1.

Referring now to the drawings wherein aspects of the subject application are shown, FIGS. 1 and 2 are various views of a sports ball 100 in accordance with an embodiment of the present disclosure. FIG. 1 shows an exterior of the sports ball and FIG. 2 shows a cross-sectional view of the sports ball. The sports ball illustrated in FIGS. 1 and 2 has an outer surface made up of twelve shell sections each of which has a pentagonal shape. Sections 102*a*-102*h* making up the cover of the sports ball are visible in FIGS. 1 and 2. Note that there are four additional pads that are not visible in FIGS. 1 and 2 because they are on the opposite side of the sports ball from the perspective shown. It will be understood by a skilled practitioner that other numbers of sections or shapes of sections may be used in the design of other embodiments of sports balls in accordance with the present disclosure.

As indicated in FIGS. 1 and 2 the twelve shell sections are connected by a plurality of seams that are sewn with a thread. As indicated in FIG. 1, there is a single seam 104*a*-104*e* that connects pad 102*g* on each of its five sides to its five neighboring (or adjacent) sections 102*a*, 102*b*, 102*h*, 102*e*, and 102*f*. A completed twelve-sided (that is, twelve sections) ball with pentagonal sections has a total of 12 seams connecting sections together. In an embodiment, the seams are sewn with thread such as bees waxed nylon thread or polyester thread. In an embodiment, multi-ply (e.g., 3-ply, 4-ply, or 5-ply) nylon thread may be used. In another embodiment, double-stitching is used resulting in still stronger tension (e.g., 12-ply). Also indicated in FIG. 1 is a hole 106 through which the needle passes when a finishing knot is positioned inside the ball.

FIG. 2 provides a cross-sectional view of the ball illustrated in FIG. 1. Shown in FIG. 2 is six sections 102*a*-102*f* each with a respective seam 104*a*-104*f* connecting it to one of its five neighbors. FIG. 2 also illustrates an interior volume 110 that is substantially filled with a filler 108 as further described herein. In an embodiment as indicated in FIG. 2 the filler provides mechanical stability to the training ball while also providing sufficient mass so that the training ball will have the appropriate mass or weight for the sport for which it is being used. As will be understood by a skilled practitioner, the specific materials and quantity of materials used must be selected to suit the specific sport for which a training ball is being provided. It should be noted that the scope of the present disclosure allows sufficient flexibility to accommodate variations in sports ball regulations as are adopted from time to time by relevant governing bodies.

Figure 3:
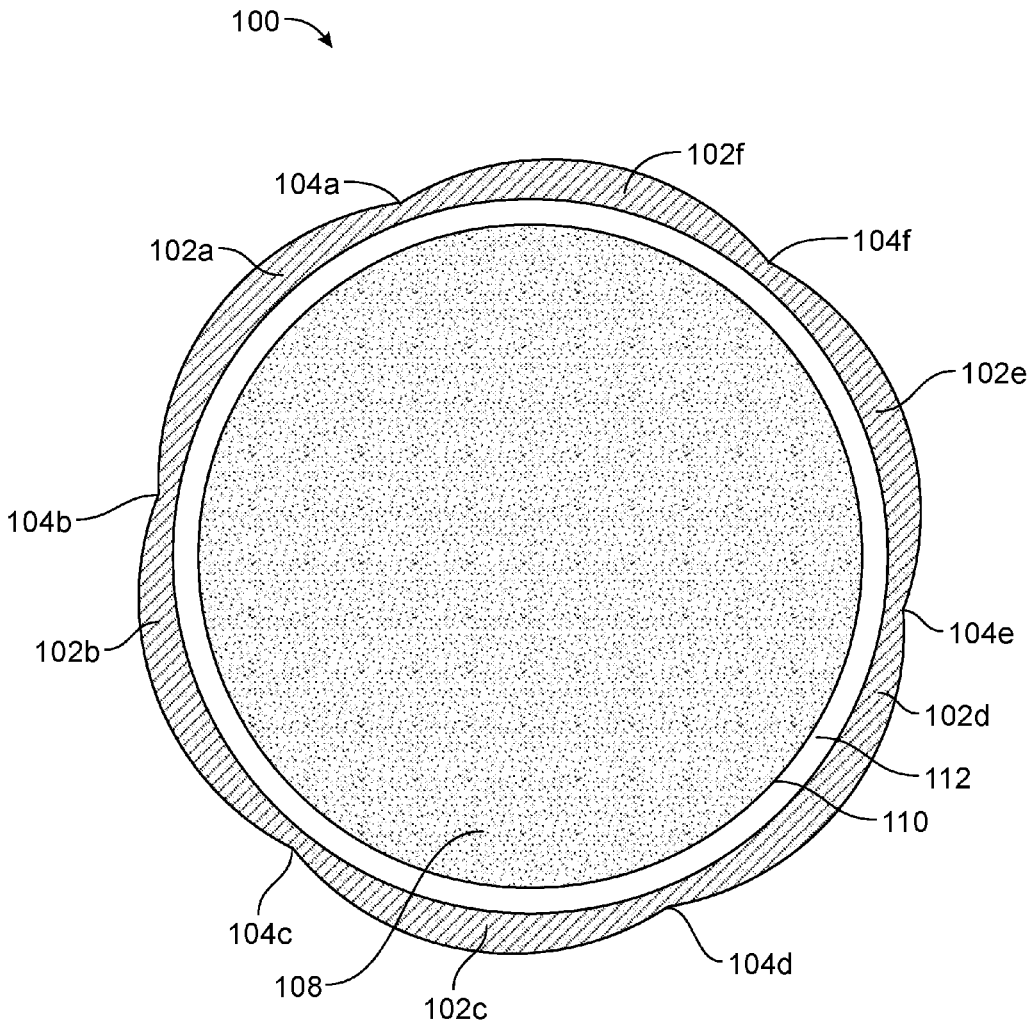
FIG. 3 is a side cross-sectional view of the sports ball as shown in FIG. 1 with an additional layer laminated to the outer shell.

FIG. 3 is a cross-sectional view of the ball illustrated in FIG. 1 showing additional layer 112 laminated to the shell sections. As further described herein, the outer shell may be joined with one or more additional layers to provide strength or impart other properties to the ball. Desirably, a flexible adhesive (not shown), such a natural or synthetic latex adhesive, is used to join the layers, although other methods such as heat, sewing or the like may be employed. The additional layers may serve to prevent leakage of the fine filler material when the ball is struck against hard surfaces. As further described herein, the additional layers may be selected from a variety of materials including non-woven polymeric materials such artificial leather materials, and in particular non-woven artificial suede, as well as natural and synthetic woven textile materials, such as cotton or polyester fabrics. The filler material 108 in this embodiment as well as other embodiments, typically 108 includes two different density materials as further described herein.

Figure 4:
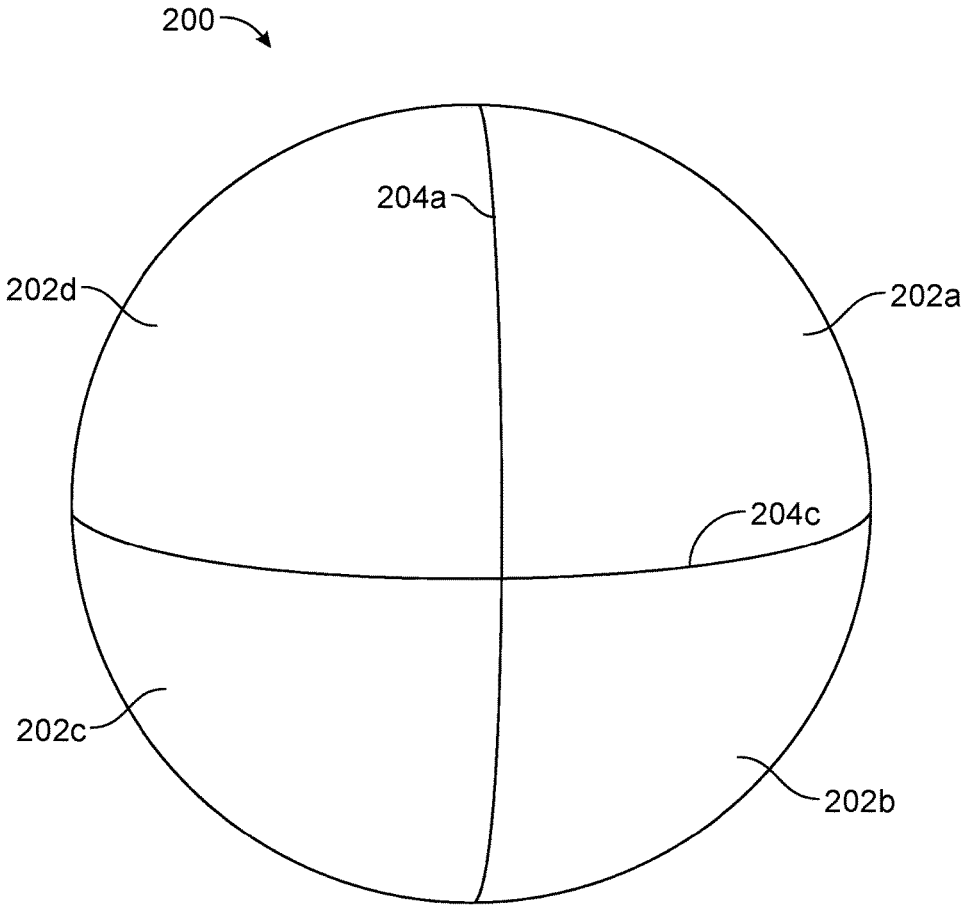
FIG. 4 is an embodiment of a sports ball of the present disclosure.

FIG. 4 shows a perspective view another sports ball made in accordance with the invention. This ball is eight-sided and is sewn together with stitching (not shown) as in FIG. 1.

Figure 5:
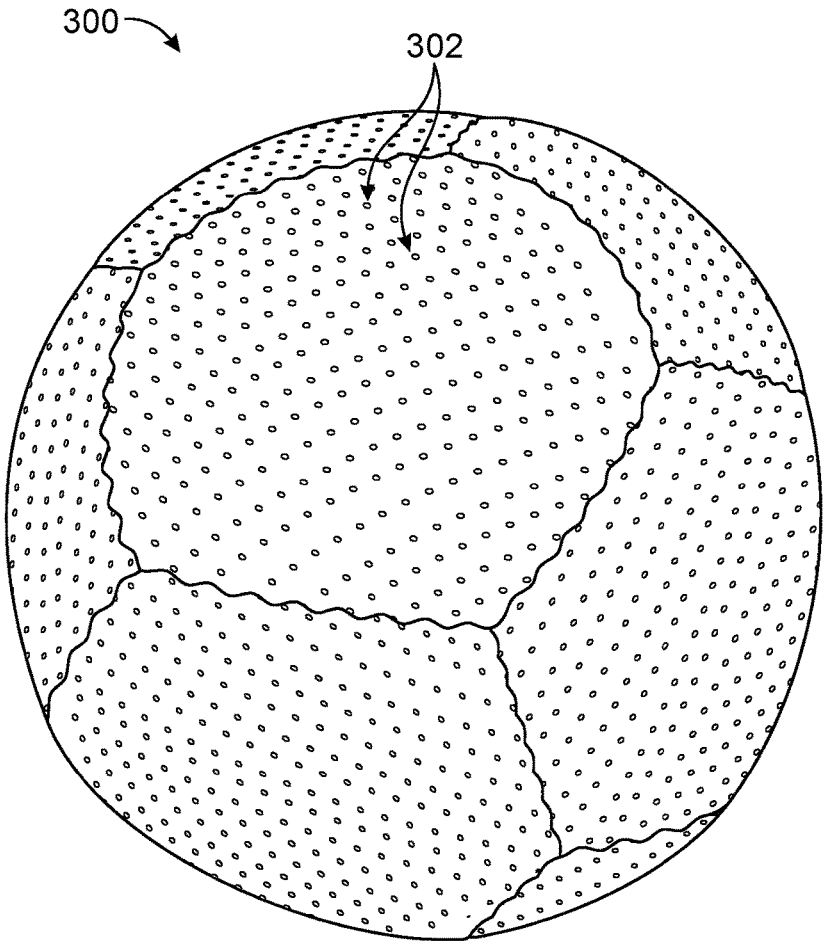
FIG. 5 is an embodiment of a lacrosse ball of the present disclosure showing a hole pattern on the surface.

FIG. 5 illustrates a lacrosse ball 300 of the present invention having a shell including an outer layer of GRIPPE PU material (available from Korea), laminated to an inner layer of Amara synthetic suede, from which exhibits the frictional forces which simulate those of a new or like-new regulation lacrosse ball. The shell includes a pattern of holes 302 on its surface.

The following examples are meant to be exemplary and not limiting of the embodiments described herein.

EXAMPLES

Representative embodiments of the present invention will be described with reference to the following examples that illustrate the principles and practice of the present invention. In no way is the scope of the invention limited to these representative embodiments.

Experiment 1: Ball Weight and Size

In Examples 1 through 3, the following samples were tested:

TABLE 2

| Samples | | |
|---|---|---|
| Description | Quantity | Sample ID |
| SWAX LAX ® Original Ball (Yellow) (Comparative Example) | 4 | Original-x |
| SWAX LAX PRO-GRIP ™ Ball (Orange) (Inventive Example) | 4 | PRO-GRIP-x |
| Juggle Ball (Silver) (Comparative Example) | 4 | Juggle-x |
| Champro ® NOCSAE Lacrosse Ball (LBN) (White) (Comparative Example) | 3 | Champro-x |
| Maverik ® NOCSAE Lacrosse Ball (Yellow) (Comparative Example) | 1 | Maverik-x |

The SWAX LAX PRO-GRIP™ Lacrosse Ball is a regulation lacrosse training ball of the present disclosure having an outer shell comprised of twelve pentagonal sections sewn together, with each section made from a layer of smooth synthetic suede having a thickness of about 0.4 mm to about 0.5 mm, and an outer layer of GRIPPE PU laminated thereon having a thickness of about 1.4 mm to about 1.5 mm. The outer shell encloses a filler comprising a mixture of about 70 grams of refined sand (falling under the Wentworth scale of fine to medium grain sand, i.e., 0.125 mm-0.5 mm in size) and about 50 grams of ground sifted rubber, with the rubber particles ranging from about 0.0625 mm to about 2 mm. The outer shell weighs about 20 grams.

The SWAX LAX® Original Lacrosse Ball is a comparative regulation lacrosse training ball having an outer shell comprised of twelve pentagonal sections sewn together, with each section made from WRP-7400 by Japanese Teijin Cordley having a thickness of about 1.3 mm. The outer shell encloses a filler comprising a mixture of about 75 g-about 80 g of refined sand (falling under the Wentworth scale of fine to medium grain sand, i.e., 0.125 mm-0.5 mm in size) and about 55 g-about 57 g of ground sifted rubber, with the rubber particles ranging from about 0.0625 mm to about 2 mm. The outer shell weighs about 12 g-about 15 g. The Juggle Ball is the Hybrid 2.55" TX Juggle Ball made by Flying Clipper (https://www.flyingclipper.com/hybrid-2-55-tx-juggle-ball-2). The ball is made using two layers of outer material having crushed rock between the layers, thereby isolating most of the ball's weight to its outer rim. The interior of the ball is filled to volume with recycled plastic pellets. According to the official product specifications, it has a diameter of 2.55" and a weight of 120 grams.

The Champro® NOCSAE Lacrosse Ball is a comparative regulation lacrosse ball made entirely of molded rubber.

The Maverik® NOCSAE Lacrosse Ball is a comparative regulation lacrosse ball made entirely of molded rubber.

Testing procedures were followed as specified within NOCSAE (ND) 049-14m15. NOCSAE (ND) 049-14m15 is the "Standard Performance Specification for Newly Manufactured Lacrosse Balls."

The samples were weighed and the results are shown in Table 3. "Specifications" or "regulation specifications" as used in the tables is the range of approved weight and size for regulation lacrosse balls. Accordingly, the weights of the SWAX LAX® Original Balls and SWAX LAX PRO-GRIP™ Balls fell within the standard for regulation lacrosse balls, while the Juggle Balls were too light to meet regulation standards.

TABLE 3

| Ball Mass | |
|---|---|
| Sample ID | Weight Value (oz) |
| Original-1 (Comparative Example) | 5.07 |
| Original-2 (Comparative Example) | 5.12 |
| Original-3 (Comparative Example) | 5.12 |
| Original-4 (Comparative Example) | 5.03 |
| PRO-GRIP-2 (Inventive) | 5.04 |
| PRO-GRIP-3 (Inventive) | 5.12 |
| PRO-GRIP-4 (Inventive) | 5.03 |
| Juggle-1 (Comparative Example) | 4.67 |
| Juggle-2 (Comparative Example) | 4.64 |
| Juggle-3 (Comparative Example) | 4.61 |
| Juggle-4 (Comparative Example) | 4.64 |
| Champro-1 (Comparative Example) | 5.15 |
| Champro-2 (Comparative Example) | 5.13 |
| Champro-3 (Comparative Example) | 5.12 |
| Maverik-1 (Comparative Example) | 5.08 |
| Regulation specifications | 5.0-5.25 |

The samples were measured and the results are shown in Table 4. The circumference of the SWAX LAX PRO-GRIP™ Balls fell within the standard for regulation lacrosse balls, while the Juggle Balls were too large to meet regulation standards.

TABLE 4

| Ball Circumference | | | |
|---|---|---|---|
| | Circumference Value (in) | | |
| Sample ID | Measurement 1 | Measurement 2 | Average |
| PRO-GRIP-1 (Inventive) | 7.80 | 7.71 | 7.76 |
| PRO-GRIP-2 (Inventive) | 7.73 | 7.78 | 7.76 |
| PRO-GRIP-4 (Inventive) | 7.75 | 7.82 | 7.79 |
| Juggle-1 (Comparative Example) | 8.52 | 8.61 | 8.56 |
| Juggle-2 (Comparative Example) | 8.52 | 8.59 | 8.56 |
| Juggle-3 (Comparative Example) | 8.53 | 8.50 | 8.51 |
| Juggle-4 (Comparative Example) | 8.61 | 8.62 | 8.61 |
| Champro-1 (Comparative Example) | 7.82 | 7.80 | 7.81 |
| Champro-2 (Comparative Example) | 7.80 | 7.80 | 7.80 |
| Champro-3 (Comparative Example) | 7.80 | 7.80 | 7.80 |
| Maverik-1 (Comparative Example) | 7.75 | 7.77 | 7.76 |
| Regulation specifications | | | 7.75-8 |

Experiment 2: Ball Compression

Ball Compression (C-D) was performed per the procedures of Standard Performance Specification for Newly Manufactured Lacrosse Balls NOCSAE (ND) 049-15m17. Each ball was compressed between two platens to 25% of its diameter and the pounds required to achieve that compression (the "compression load") was measured. The results are shown in Table 5.

TABLE 5

| Ball Compression (C-D) | | |
|---|---|---|
| Sample ID | Compression Load (lbs) | Deflection (in) |
| Original-1 (Comparative Example) | 47 | 0.60 |
| Original-2 (Comparative Example) | 51 | 0.60 |
| Original-3 (Comparative Example) | 39 | 0.60 |
| Original-4 (Comparative Example) | 50 | 0.59 |
| PRO-GRIP-1 | 81 | 0.62 |
| PRO-GRIP-2 | 74 | 0.62 |
| PRO-GRIP-3 | 81 | 0.60 |
| PRO-GRIP-4 | 90 | 0.62 |
| Juggle-1 (Comparative Example) | 30 | 0.68 |
| Juggle-2 (Comparative Example) | 32 | 0.68 |
| Juggle-3 (Comparative Example) | 29 | 0.68 |
| Juggle-4 (Comparative Example) | 51 | 0.69 |
| Champro-1 (Comparative Example) | 145 | 0.62 |
| Champro-2 (Comparative Example) | 147 | 0.62 |
| Champro-3 (Comparative Example) | 150 | 0.62 |
| Maverik-1 (Comparative Example) | 176 | 0.62 |
| Regulation specifications | 160 ± 50 | |

The results demonstrate that the inventive SWAX LAX PRO-GRIP™ Balls compress significantly more than the standard regulation lacrosse balls, i.e., the Champro and Maverik balls. With the increased compression of the inventive balls of the disclosure, the point of impact, be that a player's body or the ground, is diffused leading to less potential for pain and injury to players and less destruction to walls and bleachers, for example.

Also, as shown in the table, it takes a greater compression load to compress SWAX LAX PRO-GRIP™ Balls than the SWAX LAX® Original Balls.

Experiment 3: Ball Coefficient of Restitution (COR)

Ball COR was performed per the requirements of Standard Performance Specification for Newly Manufactured Lacrosse Balls NOCSAE (ND) 049-15m17. Coefficient of Restitution (COR) testing is performed by firing a ball at a steel plate of specified dimensions, measuring the inbound and rebound velocity. The COR is the percentage of speed lost between the inbound and rebound velocity. Ball COR testing was used to assess ball durability rather than ball rebound speed. Regulation specifications for COR inbound velocity (mph) is 60±3% and 0.60-0.70 for COR Value.

Samples were stored for a minimum period of 24 hours at a constant temperature of 72° F.±4° F. at a relative humidity of 50±20% prior to testing.

TABLE 6

| Ball COR for Original SWAX LAX Ball (Comparative Example) | | | |
|---|---|---|---|
| Sample ID | Impact | Inbound Velocity (mph) | Observations |
| Original-1 | 1 | 59 | No change |
| | 2 | 59 | No change |
| | 3 | 59 | No change |
| | 4 | 61 | Thread started to pull out |
| | 5 | 60 | No change |
| | 6 | 59 | No change |
| | 7 | 61 | No change |
| | 8 | 67 | No change |
| | 9 | 61 | No change |
| | 10 | 62 | No change |
| | 11 | 63 | No change |
| | 12 | 62 | No change |
| | 13 | 61 | No change |
| | 14 | 62 | No change |
| | 15 | 61 | No change |
| | 16 | 63 | No change |
| | 17 | 62 | No change |
| | 18 | 61 | No change |
| | 19 | 64 | No change |
| | 20 | 63 | No change |
| | 21 | 62 | No change |
| | 22 | 63 | No change |
| | 23 | 61 | No change |

TABLE 6-continued

Ball COR for Original SWAX LAX Ball (Comparative Example)

| Sample ID | Impact | Inbound Velocity (mph) | Observations |
|---|---|---|---|
| | 24 | 61 | No change |
| | 25 | 65 | No change |
| | 26 | 65 | No change |
| | 27 | 60 | No change |
| | 28 | 63 | No change |
| | 29 | 62 | No change |
| | 30 | 62 | No change |
| | 31 | 58 | No change |
| | 32 | 63 | No change |
| | 33 | 63 | No change |
| | 34 | 62 | No change |
| | 35 | 62 | No change |
| | 36 | 55 | No change |
| | 37 | 63 | No change |
| | 38 | 61 | No change |
| | 39 | 62 | No change |
| | 40 | 633 | No change |
| | 41 | 62 | No change |
| | 42 | 61 | No change |
| | 43 | 64 | No change |
| | 44 | 63 | No change |
| | 45 | 62 | No change |
| | 46 | 62 | No change |
| | 47 | 62 | No change |
| | 48 | 63 | Some wear, broken stitches, paint missing, softer feel to ball |

TABLE 7

Ball COR for PRO-GRIP Sample (Inventive)

| Sample ID | Impact | Inbound Velocity (mph) | Observations |
|---|---|---|---|
| PRO-GRIP-1 | 1 | 61 | No change |
| | 2 | 61 | No change |
| | 3 | 65 | No change |
| | 4 | 60 | No change |
| | 5 | 63 | No change |
| | 6 | 61 | No change |
| | 7 | 60 | No change |
| | 8 | 60 | No change |
| | 9 | 56 | No change |
| | 10 | 57 | No change |
| | 11 | 61 | No change |
| | 12 | 60 | Minimal seam damage |
| | 13 | 61 | No change |
| | 14 | 68 | No change |
| | 15 | 63 | No change |
| | 16 | 66 | No change |
| | 17 | 66 | No change |
| | 18 | 57 | No change |
| | 19 | 61 | No change |
| | 20 | 63 | No change |
| | 21 | 63 | No change |
| | 22 | 68 | No change |
| | 23 | 67 | No change |
| | 24 | 57 | No change |
| | 25 | 53 | No change |
| | 26 | 55 | No change |
| | 27 | 65 | No change |
| | 28 | 68 | No change |
| | 29 | 66 | No change |
| | 30 | 63 | No change |
| | 31 | 57 | No change |
| | 32 | 54 | No change |
| | 33 | 55 | No change |
| | 34 | 70 | No change |
| | 35 | 63 | No change |
| | 36 | 61 | No change |
| | 37 | 59 | No change |
| | 38 | 58 | No change |

TABLE 7-continued

Ball COR for PRO-GRIP Sample (Inventive)

| Sample ID | Impact | Inbound Velocity (mph) | Observations |
|---|---|---|---|
| | 39 | 61 | No change |
| | 40 | 61 | No change |
| | 41 | 57 | No change |
| | 42 | 64 | No change |
| | 43 | 55 | No change |
| | 44 | 65 | No change |
| | 45 | 63 | No change |
| | 46 | 60 | No change |
| | 47 | 57 | No change |
| | 48 | 58 | Some wear, softer feel to ball |

TABLE 8

Ball COR for Juggle Ball Samples (Comparative Examples)

| Sample ID | Impact | Inbound Velocity (mph) | Observations |
|---|---|---|---|
| Juggle-1 | 1 | 39 | No change |
| | 2 | 55 | No change |
| | 3 | 64 | Seam starts breaking |
| | 4 | 65 | 2 seams busted open, beads released |
| | 5 | N/A | No change |
| | 6 | N/A | No change |
| Juggle-2 | 1 | 55 | No change |
| | 2 | 66 | Seam ripping |
| | 3 | 59 | No change |
| | 4 | 70 | No change |
| | 5 | 72 | No change |
| | 6 | 60 | No change |
| | 7 | 74 | 2 seams busted open, beads released |
| Juggle-3 | 1 | 51 | No change |
| | 2 | 63 | Seam ripping |
| | 3 | 69 | Seams busted open, beads released, fabric patch ripped |
| | 4 | N/A | No change |
| | 5 | N/A | No change |
| | 6 | N/A | No change |
| Juggle-4 | 1 | 57 | No change |
| | 2 | 65 | Seam ripped |
| | 3 | 70 | Seams busted open, beads released |
| | 4 | N/A | No change |
| | 5 | N/A | No change |
| | 6 | N/A | No change |

TABLE 9

Ball COR for Champro and Maverik Samples (Comparative Examples)

| Sample ID | Impact | Inbound Velocity (mph) | Rebound Velocity (mph) | COR Value |
|---|---|---|---|---|
| Champro-1 | 1 | 60 | 38 | 0.63 |
| | 2 | 61 | 39 | |
| | 3 | 61 | 38 | |
| | 4 | 60 | 37 | |
| | 5 | 59 | 37 | |
| | 6 | 60 | 37 | |
| Champro-2 | 1 | 59 | 37 | 0.63 |
| | 2 | 60 | 38 | |
| | 3 | 60 | 38 | |
| | 4 | 6 | 38 | |
| | 5 | 59 | 37 | |
| | 6 | 60 | 37 | |
| Champro-3 | 1 | 60 | 38 | 0.64 |
| | 2 | 59 | 37 | |
| | 3 | 60 | 38 | |
| | 4 | 60 | 38 | |

TABLE 9-continued

| Ball COR for Champro and Maverik Samples (Comparative Examples) | | | | |
|---|---|---|---|---|
| Sample ID | Impact | Inbound Velocity (mph) | Rebound Velocity (mph) | COR Value |
| | 5 | 61 | 39 | |
| | 6 | 60 | 38 | |
| Maverik-1 | 1 | 59 | 38 | 0.65 |
| | 2 | 60 | 39 | |
| | 3 | 60 | 39 | |
| | 4 | 59 | 38 | |
| | 5 | 59 | 38 | |
| | 6 | 59 | 38 | |

These results show the difference in durability between, e.g., the SWAX LAX PRO-GRIP™ Ball and the Juggle Ball. Whereas the inventive SWAX LAX PRO-GRIP™ Ball withstands over 48 throws at a velocity over 55 mph to 70 mph, the Juggle Ball begins to rip at the seams and release beads after just 7 or fewer similar throws at a velocity over 55 mph to 70 mph. In part, this is due to the shape and design of the filler of the Juggle Ball. The Juggle Ball is filled with oblong plastic beads, which, upon impact, become projectiles, which break through the seams of the outer layer. Thus, it was found that the filler of the inventive SWAX LAX PRO-GRIP™ Ball contributed to increased durability of the ball over the comparative Juggle Ball.

Experiment 4: Peel Adhesion Test

Testing procedures were followed as specified within NOCSAE (ND) 019-10m1 5a "Standard Test Method and Performance Requirements for Newly Manufactured Football Players Hand Coverings", Clause 9.1 Peel Adhesion Test. In short, the peel adhesion test is performed by placing the sample face down on a piece of pebbled glass (pattern #62) with a weight placed thereon for at least an hour. After an hour, the weight is removed, the glass is inverted and the time it takes the sample to fall from the glass is recorded.

Samples were stored for a minimum 24 hours at a constant temperature of 72±5° F. (22±2° C.) prior to testing. The test was performed at a temperature of 73.8° F.

Fabric swatches were prepared for each of the following materials:

TABLE 10

| Samples | | |
|---|---|---|
| Description | Quantity | Sample ID |
| Single layer outer shell fabric of SWAX LAX PRO-GRIP ™ outer shell, KR GRIPPE PU (Orange) | 3 | PRO-GRIP Shell-x |
| Fabric of Juggle Ball outer shell (Gold) (Comparative Example) | 3 | Juggle Ball Shell-x |
| Fabric of SWAX LAX ® Original Ball outer shell, WRP-7400 Fabric (Silkscreen Purple) (Comparative Example) | 3 | Original Shell-x |

The size of each sample must be cut such that its weight is less than 4 grams. Here the samples were cut to be about 3"×3" or less. The results of the test are presented in Table 11.

TABLE 11

| Peel Adhesion Test | | | |
|---|---|---|---|
| Sample ID | Sample Weight (g) | Weighted Duration (hr:min) | Hang Time (s) |
| PRO-GRIP Shell-1 | 2.491 | 1:01 | 50 |
| PRO-GRIP Shell-2 | 2.577 | 1:01 | 35 |
| PRO-GRIP Shell-3 | 2.550 | 1:01 | 20 |
| Juggle Ball Shell-1 | 2.445 | 1:01 | 0 |
| Juggle Ball Shell-2 | 2.469 | 1:01 | 0 |
| Juggle Ball Shell-3 | 2.473 | 1:01 | 0 |
| Original Shell-1 | 20898 | 1:01 | 0 |
| Original Shell-2 | 2.952 | 1:01 | 0 |
| Original Shell-3 | 2.897 | 1:01 | 0 |
| Specifications | ≤4 | ≥1 | ≤90 |

The results of the peel adhesion test show that the fabric of the outer shell of the inventive SWAX LAX PRO-GRIP™ Ball has a hang time of 20-50 seconds, while the other samples have a hang time of zero seconds. Accordingly, the outer shell of the SWAX LAX PRO-GRIP™ Ball is significantly stickier that the outer shell of the Juggle ball or the SWAX LAX® Original Ball. This provides for a ball having increased friction on its surface, thereby being more similar in feel during play to a new rubber regulation lacrosse ball.

It will be appreciated by those skilled in the art that changes could be made to various aspects described above without departing from the broad inventive concepts and spirit of the invention. It is understood that the subject application is not limited to the particular aspects disclosed, but is intended to cover modifications within the spirit and scope of the subject matter as disclosed and defined by the claims.

What is claimed:

1. A lacrosse ball comprising:

an outer shell layer defining an enclosure having an interior volume for housing a composite filler material, the outer shell layer comprising a plurality of sections connected along a plurality of seams, the sections having an outer surface comprising a substrate being leather or a synthetic non-woven material, and a surface coating on an exterior side of the substrate, and the sections having an inner woven or non-woven fabric layer joined on an interior side of the substrate; and the composite filler material wherein the inner woven or non-woven fabric layer is a synthetic suede.

2. The lacrosse ball of claim 1, wherein the substrate is a substantially smooth non-woven synthetic leather.

3. The lacrosse ball of claim 1, wherein the lacrosse ball remains intact after being thrown 10 or more consecutive times against metal plates at speeds of about 50-about 70 mph.

4. The lacrosse ball of claim 1, wherein the weight and size of the ball are substantially the same as the weight and size of the regulation lacrosse ball.

5. The lacrosse ball of claim 1, wherein the weight of the ball is about 130 g to about 155 g.

6. The lacrosse ball of claim 1, wherein the weight of the ball is about 5 ounces (about 142 g) to about 5.25 ounces (about 149 g).

7. The lacrosse ball of claim 1, wherein the ball is compressed to about 25% its diameter between two platens under a compression load of about 55 lbs to about 100 lbs.

8. The lacrosse ball of claim 1, wherein the circumference of the ball is about 7.5 inches (about 19.05 cm) to about 8.5 inches (about 21.59 cm).

9. The lacrosse ball of claim 8, wherein the circumference of the ball is about 7.75 inches (about 19.68 cm) to about 8.0 inches (about 20.32 cm).

10. The lacrosse ball of claim 1, wherein the diameter of the ball is about 64 mm+/−4 mm.

11. The lacrosse ball of claim 2, wherein the synthetic leather comprises a microfiber.

12. The lacrosse ball of claim 1, wherein the substrate comprises a polymer selected from the group consisting of polyurethane, polyester, nylon, polyethylene terephthalate (PET), acrylic, polyolefin and combinations thereof.

13. The lacrosse ball of claim 1, wherein the inner woven or non-woven fabric layer is selected from the group consisting of polyurethane, cotton, polyester, nylon, polyethylene terephthalate (PET), acrylic, polyolefin, and combinations thereof.

14. The lacrosse ball of claim 1, wherein the outer shell layer substrate and the inner woven or non-woven fabric layer are joined by an adhesive.

15. The lacrosse ball of claim 1, wherein the composite filler material is selected from the group consisting of medium to fine sand, comminuted stone, comminuted polymer, comminuted rubber (elastomer) and combinations thereof.

16. The lacrosse ball of claim 15, wherein the composite filler material comprises a material selected from the group consisting of: refined sand comprising fine grade to medium grade sand (about 0.125 mm to about 0.5 mm); comminuted rubber (elastomer); comminuted stone; and combinations thereof.

17. The lacrosse ball of claim 15, wherein the composite filler material comprises a first filler material having a first density and a second filler material having a different density from the first, wherein the weight ratio of the first material to the second material is about 50:80 to about 90:40, and wherein the first material is sand and the second material is rubber.

18. The lacrosse ball of claim 1, wherein the weight of the outer shell layer is about 10 g to about 20 g.

19. The lacrosse ball of claim 1, wherein the substrate increases the coefficient of friction of the outer surface of the lacrosse ball.

20. The lacrosse ball of claim 1, wherein the surface coating comprises a polyurethane or silicone.

21. The lacrosse ball of claim 20, wherein the substrate is a substantially smooth non-woven synthetic leather and the coating comprises a polyurethane.

22. The lacrosse ball of claim 18, wherein the substrate comprises a texture, a pattern or a textured pattern.

23. A lacrosse ball comprising:

an outer shell layer defining an enclosure having an interior volume for housing a composite filler material, and the composite filler material comprising a first material and a second material, wherein the outer shell layer comprises a plurality of sections connected along a plurality of seams, the sections having an outer surface including i) a synthetic non-woven leather, and ii) a surface coating on an exterior side of the synthetic non-woven leather, and an inner fabric layer comprising a synthetic suede adhered on an interior side of the outer surface, and wherein the weight of the ball is about 130 g to about 155 g and the circumference of the ball is about 7.5 inches to about 8.5 inches.

* * * * *